US008297367B2

(12) United States Patent
Chen et al.

(10) Patent No.: US 8,297,367 B2
(45) Date of Patent: Oct. 30, 2012

(54) MECHANISM FOR ACTIVATING A PLURALITY OF DOWNHOLE DEVICES

(75) Inventors: Kuo-Chiang Chen, Sugar Land, TX (US); Hitoshi Tashiro, Cambridge, MA (US); Iain Cooper, Sugar Land, TX (US); Jahir Pabon, Newton, MA (US); Murat Ocalan, Boston, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 265 days.

(21) Appl. No.: 12/784,612

(22) Filed: May 21, 2010

(65) Prior Publication Data

US 2011/0284240 A1 Nov. 24, 2011

(51) Int. Cl.
*E21B 34/06* (2006.01)

(52) U.S. Cl. ..... 166/386; 166/66.5; 166/318

(58) Field of Classification Search ..... 166/386, 166/66.5, 318, 332.4
See application file for complete search history.

(56) References Cited

U.S. PATENT DOCUMENTS

| | | | | |
|---|---|---|---|---|
| 3,086,589 | A * | 4/1963 | McGowen, Jr. | 166/65.1 |
| 6,988,556 | B2 | 1/2006 | Vick, Jr. | |
| 7,479,884 | B1 | 1/2009 | Fullerton | |
| 2004/0000406 | A1 | 1/2004 | Allamon et al. | |
| 2007/0272411 | A1 | 11/2007 | Lopez De Cardenas et al. | |
| 2007/0289734 | A1 | 12/2007 | McDonald et al. | |
| 2008/0236819 | A1 * | 10/2008 | Foster et al. | 166/255.2 |
| 2009/0146793 | A1 | 6/2009 | Fullerton | |
| 2009/0249612 | A1 | 10/2009 | Fullerton et al. | |
| 2009/0250032 | A1 | 10/2009 | Fullerton et al. | |
| 2009/0250574 | A1 | 10/2009 | Fullerton et al. | |
| 2009/0250575 | A1 | 10/2009 | Fullerton et al. | |
| 2009/0250576 | A1 | 10/2009 | Fullerton et al. | |
| 2009/0251238 | A1 | 10/2009 | Fullerton et al. | |
| 2009/0251239 | A1 | 10/2009 | Fullerton et al. | |
| 2009/0251240 | A1 | 10/2009 | Fullerton et al. | |
| 2009/0251241 | A1 | 10/2009 | Fullerton et al. | |
| 2009/0251242 | A1 | 10/2009 | Fullerton et al. | |
| 2009/0251243 | A1 | 10/2009 | Fullerton et al. | |
| 2009/0251244 | A1 | 10/2009 | Fullerton et al. | |
| 2009/0251245 | A1 | 10/2009 | Fullerton et al. | |
| 2009/0251246 | A1 | 10/2009 | Fullerton et al. | |
| 2009/0251247 | A1 | 10/2009 | Fullerton et al. | |
| 2009/0251248 | A1 | 10/2009 | Fullerton et al. | |
| 2009/0251249 | A1 | 10/2009 | Fullerton et al. | |
| 2009/0251251 | A1 | 10/2009 | Fullerton et al. | |

(Continued)

FOREIGN PATENT DOCUMENTS

WO 2009123718 A1 10/2009

(Continued)

OTHER PUBLICATIONS

International Search Report of PCT Application No. PCT/US2011/034090 dated Oct. 28, 2011: pp. 1-4.

(Continued)

*Primary Examiner* — Wiiliam P Neuder

(57) ABSTRACT

A mechanism for selectively activating a plurality of downhole pathways including a) a valve having: i) a sleeve coupled for movement between an open and normally closed position; and ii) a valve magnet set mounted to the sleeve; and b) a dart for pumping in hole including a dart magnet set matched to the valve magnet set such that the dart couples to the valve when in close proximity and, in turn, the sleeve moves from the closed position to the open position.

20 Claims, 13 Drawing Sheets

U.S. PATENT DOCUMENTS

2009/0251253 A1 10/2009 Fullerton et al.
2009/0251254 A1 10/2009 Fullerton et al.
2009/0251255 A1 10/2009 Fullerton et al.
2009/0251256 A1 10/2009 Fullerton et al.
2009/0251259 A1 10/2009 Fullerton et al.
2009/0251260 A1 10/2009 Fullerton et al.
2009/0251261 A1 10/2009 Fullerton et al.
2009/0251262 A1 10/2009 Fullerton et al.
2009/0251263 A1 10/2009 Fullerton et al.
2009/0251264 A1 10/2009 Fullerton et al.
2009/0251265 A1 10/2009 Fullerton et al.
2009/0251351 A1 10/2009 Fullerton et al.
2009/0252671 A1 10/2009 Fullerton
2009/0261093 A1 10/2009 Fullerton et al.
2009/0261166 A1 10/2009 Lawson et al.
2009/0273422 A1 11/2009 Fullerton et al.
2009/0273424 A1 11/2009 Fullerton et al.
2009/0278642 A1 11/2009 Fullerton et al.
2009/0284336 A1 11/2009 Fullerton et al.
2009/0288241 A1 11/2009 Fullerton et al.
2009/0288244 A1 11/2009 Fullerton et al.
2009/0288283 A1 11/2009 Fullerton et al.
2009/0288316 A1 11/2009 Fullerton et al.
2009/0288528 A1 11/2009 Fullerton et al.
2009/0289063 A1 11/2009 Fullerton et al.
2009/0289089 A1 11/2009 Fullerton et al.
2009/0289090 A1 11/2009 Fullerton et al.
2009/0289749 A1 11/2009 Fullerton et al.
2009/0290363 A1 11/2009 Fullerton et al.
2009/0292371 A1 11/2009 Fullerton et al.
2009/0295521 A1 12/2009 Fullerton et al.
2009/0295522 A1 12/2009 Fullerton et al.
2009/0302985 A1 12/2009 Fullerton et al.
2010/0045412 A1 2/2010 Fullerton et al.
2010/0045413 A1 2/2010 Fullerton et al.
2010/0045414 A1 2/2010 Fullerton et al.
2010/0045415 A1 2/2010 Fullerton et al.
2010/0045416 A1 2/2010 Fullerton et al.
2011/0056692 A1* 3/2011 Lopez de Cardenas et al. ..... 166/305.1
2012/0006562 A1* 1/2012 Speer et al. ..... 166/373

FOREIGN PATENT DOCUMENTS

WO 2009124030 A1 10/2009
WO 2009151500 A1 12/2009

OTHER PUBLICATIONS

Mallinson, "One-Sided Fluxes—A Magnetic Curiosity?" IEEE Transactions on Magnetics, Dec. 1973, vol. Mag9(4): pp. 678-682.

* cited by examiner

MECHANISM FOR ACTIVATING A PLURALITY OF DOWNHOLE DEVICES

BACKGROUND OF THE DISCLOSURE

1. Field of the Disclosure

The subject disclosure relates generally to recovery of hydrocarbons in subterranean formations, and more particularly to a mechanism for activating a plurality of downhole devices such as when creation of multiple production zones is desired.

2. Background of the Related Art

There are many situations when one would like to selectively activate multiple downhole devices. For example, in typical wellbore operations, various treatment fluids may be pumped into the well and eventually into the formation to restore or enhance the productivity of the well. For example, a non-reactive fracturing fluid may be pumped into the wellbore to initiate and propagate fractures in the formation thus providing flow channels to facilitate movement of the hydrocarbons to the wellbore so that the hydrocarbons may be pumped from the well.

In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e., oil, gas or water) into the wellbore. Often, it is desirable to have multiple production zones which are treated differently within the same wellbore. To isolate and treat each zone separately, the prior art mechanisms have been very time consuming and expensive among other drawbacks.

Referring now to FIG. 1, an exemplary layout 10 of valves 12, sleeves 14 and zones 16 to be stimulated is shown. The sleeves 14 are slideably mounted within the valves 12 to selectively open pathways 18. As illustrated, there is one valve 12 per zone 16. Each valve 12 is fixed in place by cement 20 and separated by casings 22. Although only three zones 16 are shown, there may be any desired number of casing valves 12 with sliding sleeves 14 cemented in a well.

Due to the heterogeneous nature of formation, one might not want to open all the valves simultaneously so that the fracturing operations can be performed separately for different layers of formations. The most common embodiment of doing so is using graduated balls or darts to open the valves 12 from the bottom up. For example, the radius of the valves 12, or other restriction such as a protrusion on the sliding sleeve 14, will increase from bottom up. Then, the smallest size ball is first dropped into the well and pumped toward the bottom. The size of the ball is designed so that the ball will pass through all the valves 12 except the bottom, narrowest valve 12. The ball is stopped by the bottom valve 12 so that the sliding sleeve 18 of the bottom valve 12 is pushed to the "open" position to expose the wellbore to cemented formation. Then the fracturing operation through the bottom valve 12 can be executed. After that, the next size larger ball will be dropped to activate the second to bottom valve 12.

The drawbacks of the graduated ball activation system are that there are only a finite number of restrictions/ball sizes that can be implemented. Typical limitations are a 4.5 inch casing at the top with only a minimum of 1 inch at the bottom. Hence, five or six valves across a few hundred feet of depth is the physical limit. Further, the need for restrictions prevents the full-bore access through the valves and the valves have to be activated in a fixed sequence of, in this case, bottom-up. After activation, the balls have to be dissolved or milled to gain access to the sections therebelow, which can lead to a potentially costly intervention.

Another embodiment of valve activation at varying depth utilizes control lines to activate restrictions. Once a restriction in a particular valve is activated, the restriction is then ready to catch a ball or dart dropped from the surface in order to open the respective valve. In these embodiments, common concerns are the possible damage of control lines during run-in-hole, especially in horizontal wells. A damaged control line means that only those lines below the damaged zone can be produced, severely impacting the total potential production from the well, possibly rendering it uneconomical. Another drawback of such designs is that as the thickness of the valve increases, the internal diameter of the valve decreases in order to accommodate the complex hydraulic mechanisms in the valve.

SUMMARY OF THE INVENTION

In view of the above, there is a need for an improved mechanism which permits selective activation of multiple downhole devices without comprimising fullbore diameter. It is also preferable that one can do so not necessarily following a particular pre-determined sequence. It is also desirable that the mechanism may be easily and reliably deployed and removed. The subject technology accomplishes these and other objectives.

The present technology is directed to a mechanism for selectively activating a plurality of downhole pathways including a) a valve having: i) a sleeve coupled for movement between an open and normally closed position; and ii) a valve magnet set mounted to the sleeve; and b) a dart for pumping in hole including a dart magnet set matched to the valve magnet set such that the dart couples to the valve when in close proximity and, in turn, the sleeve moves from the closed position to the open position. Preferably, the sleeve defines a recess in which the valve magnet set is mounted and the dart includes arms moveably mounted, the dart magnet set being mounted on the arms such that upon magnetic coupling, the arms move into the recess and anchor the dart to the sleeve. The recess may have a chamfer and the arms may form an anchor portion that engages the recess with a complimentary chamferred portion that engages the chamfer during retrieval of the dart.

A plurality of similar valves may included downhole, each having a unique activation dart. Springs may be coupled to the dart arms to set a normal position thereof. The dart may also include a tail block having coupling means mounted thereto, wherein the coupling means is a tail magnet set. The present technology also includes a retrieval tool including a tool magnet set coded for coupling to the tail magnet set. The retrieval tool may includes a skirt portion for creating a closing force of the arms during coupling of the tail and tool magnet sets.

Preferably, the dart further includes a plunger selectively coupled to the arms, a guide portion and seals moveably mounted to the dart such that upon the arms engaging the sleeve, the plunger is released to pass through the guide and, in turn, move the seals to engage the sleeve.

In another embodiment, the subject technology is directed to a mechanism for selectively activating a plurality of downhole devices including first means for triggering a device by moving from an off position to an on position, and second means for moving the first means from the off position to the on position. The first means may be a sliding valve sleeve having a coded valve magnet set, and the second means may be a dart having a coded dart magnet set such that the coded valve and dart magnet sets are uniquely matched to create an attractive force when in close proximity.

The subject technology is also directed to a method for selectively activating a triggering mechanism on a plurality of downhole valves including the steps of pre-determining combinations of coded magnets such that each valve sleeve of the downhole valve includes a valve magnet set that is only attracted to unique dart magnet set mounted on an activation dart, and opening the downhole valves in a sequence by selecting a sequence of unique darts to be pumped in hole. The method may also include of having mismatched magnet sets create a repulsive force when in close proximity, dissolving the unique darts, and/or retrieving the unique darts while leaving at least one respective valve open and/or closing at least one respective valve.

It should be appreciated that the present technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
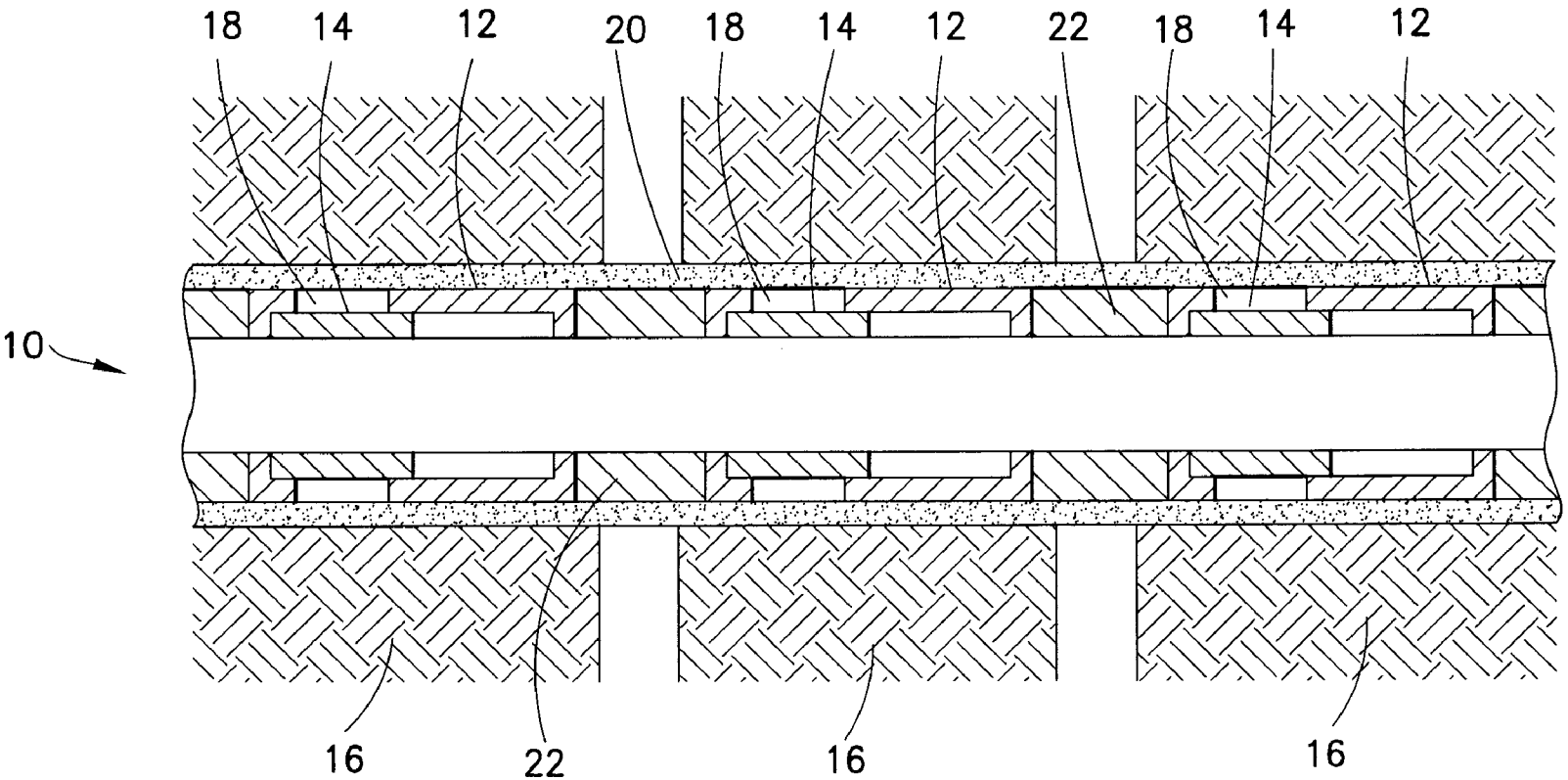
FIG.1 PRIOR ART
FIG. 1 is a cross-sectional view of a layout for a typical wellbore.

The present disclosure overcomes many of the prior art problems associated with activating a plurality of downhole devices. The advantages, and other features of the mechanism disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as inward, outward, left, right, up, and down are with reference to the Figures, and not meant in a limiting sense. Additionally, for clarity common items have not been included in the Figures as would be appreciated by those of ordinary skill in the pertinent art. Unless otherwise specified, the illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are also exemplary and unless otherwise specified, can be altered without materially affecting or limiting the disclosed technology.

In overview, several embodiments of the subject technology are directed to using correlated magnet structures to accomplish the beneficial goals noted above among others benefits. Correlated magnetic structures are programmed by imparting coded patterns of magnetic poles that determine unique magnetic field and force properties. The unique magnetic identities determine if, when and how structures will attach. The correlated magnets have strong-yet-safe magnetic fields, enable precision rotational and translational alignment, and provide rapid attachment and detachment functionality. The correlated magnets can even have multi-level magnetic fields if desired to achieve contactless attachment or repel and snap behaviors. For example, see U.S. Patent Application Publication No. 2009/0251242 A1 published on Oct. 8, 2009 to Fullerton et al., which is incorporated herein by reference in its entirety.

The correlated magnet embodiments described here involve a latching, triggering and retrieval mechanism for downhole applications. Whether the mechanism activates or not depends on a pre-determined combination of coded magnets. If the pattern of the 2 or more coded magnets matches, the mechanisms will be activated by attractive forces between these two sets of magnets. Many possible combinations can be achieved by using coded magnets. Hence, a plurality of devices, such as valves, may be selectively activated in any order without having to vary the usable wellbore diameter. One of the potential applications is multi-layer efficient fracturing valves to take advantage of the high number of stages that can be utilized without the need for control lines.

Figure 2:
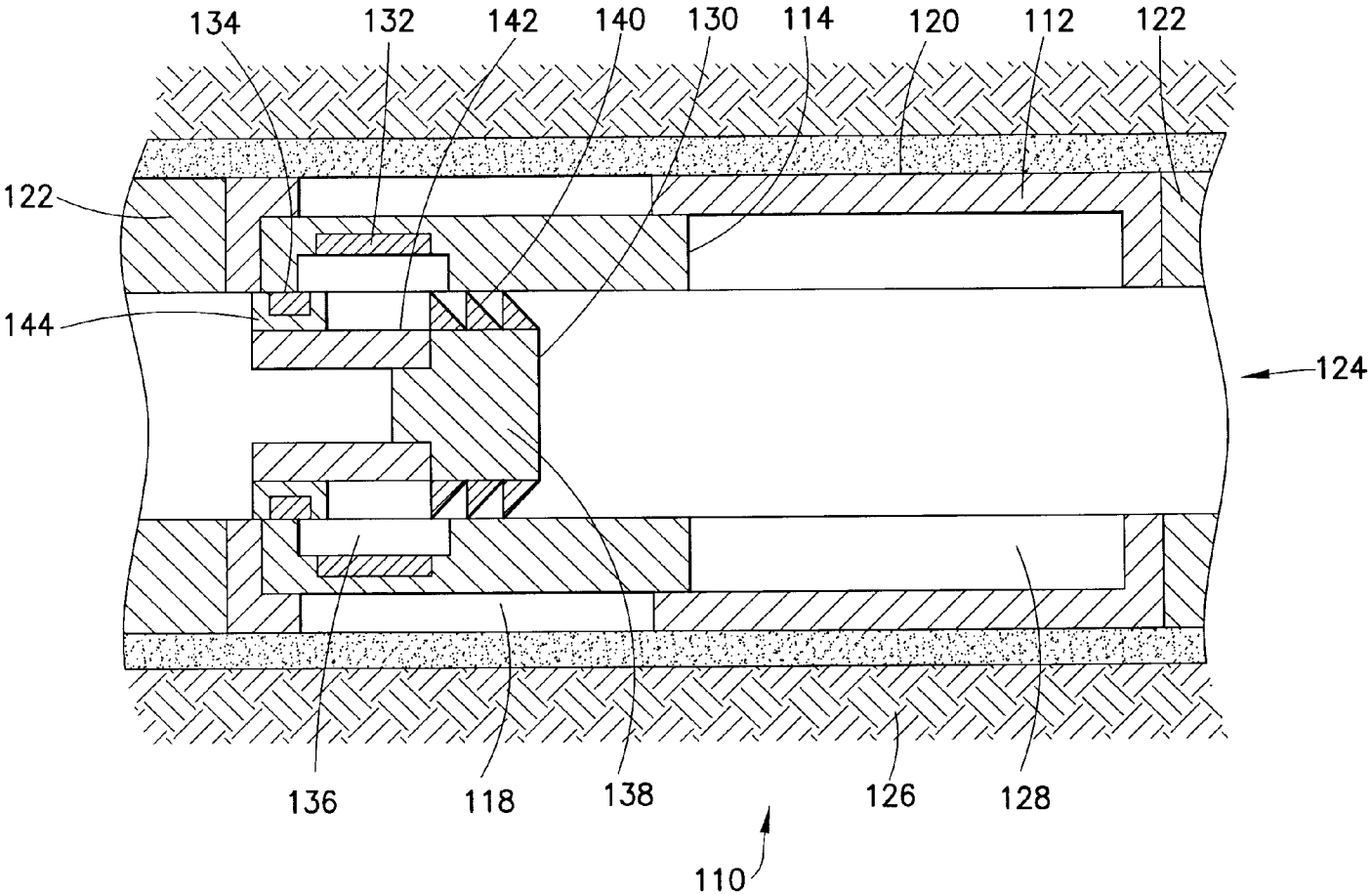
FIG. 2 is a cross-sectional view of a valve in a layout in accordance with the subject technology, wherein the activation dart is approaching the valve.

Now referring to FIG. 2, a cross-sectional view of a layout 110 having a valve 112 in the closed position in accordance with the subject technology is shown. In order to accomplish multiple zones, multiple such casing valves 112 would be run in hole with casings 122 and held in place by cement 120. Each casing valve 112 has a sliding sleeve 114, shown in the "closed" position, i.e., there is no communication between the wellbore 124 to the surrounding formation 126. In other words, the sliding sleeve 114 blocks the pathway 118 formed in the casing valve 112. The sliding sleeve 114 moves within a hollow 128 formed in the casing valve 112. Casing 122 surrounds the casing valve 112.

The sliding sleeve 114 interacts with an activation dart 130 to open the valve 112. The sleeve 114 and dart 130 include a matched pair of magnets 132, 134, respectively. The sleeve magnets 132 are imbedded adjacent a recess 136 formed in the sliding sleeve 114. The magnets 132, 134 are preferably sets of magnets to allow creation of a plurality of unique matched pairs, e.g., correlated magnets. The sets of magnets 132, 134 may include any number of magnets necessary to accomplish the performance desired. Further, the sleeve 114 and dart 130 may include a plurality of sets.

The activation dart 130 has a body or head 138 surrounded with a set of wipers or seals 140. The seals 140 form a hydraulic barrier between the space above and below the dart 130 in the wellbore, which allows dropping the dart 130 from the surface of the well and pumping the dart 130 down the well. The wipers 140 also act to clean the way in preparation for interactive latching between the dart 130 and sliding sleeve 114 to ensure that the latching operation is not contaminated by any wellbore fluid or sludge that may prevent proper operation.

The dart 130 has a set of multiple arms 142 trailing from the body 138. The arms 142 are linked to the dart body 138 by flexures or linkages (not explicitly shown) so that the arms 142 can pivot radially outward and inward from the body 138. The dart magnets 134 are imbedded at the tip or anchor 144 of the arms 142. The tips 144 protrude from the arms 142 such that during interaction with the sleeve 114, the tips 144 are captured in the recess 136. Preferably, there are small spring forces exerted on the arms 142 so that the arms 142 are normally in a neutral position as shown in FIG. 2 when the dart 130 is running in hole. Alternatively, spring forces on the arms 142 may be balanced or applied so that the normal position is biased inward or outward depending upon the desired performance.

In Operation

Figure 3:
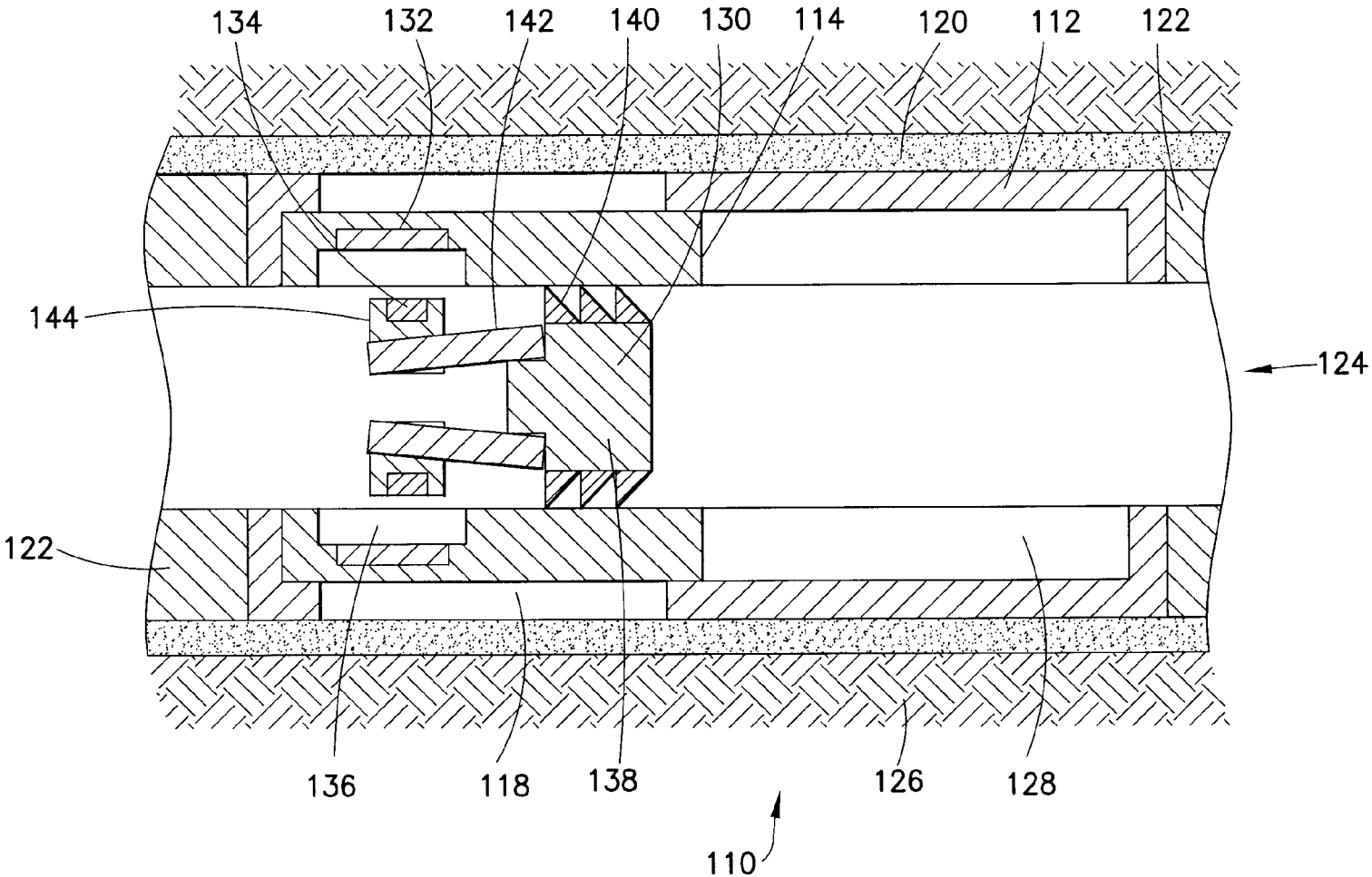
FIG. 3 is a cross-sectional view of a valve in a layout in accordance with the subject technology, wherein a non-matching activation dart has reached the valve.

To activate a valve 112, a dart 130 with dart magnets 134 tuned to match the sleeve magnets 132 for the respective valve 112 is needed. In the event that the dart magnets 134 and sleeve magnets 132 do not match, the dart 130 passes through the valve 112 as shown in FIG. 3. More particularly, as the dart magnets 134 pass by the recess 136 of the sleeve 114, the magnets 132, 134 preferably repel each other. As a result, the arm tips 144 are moved radially inward and are pumped past the recess 136 without interaction. In this case, the respective valve 112 is not activated, and the formation behind this particular valve 112 will not be affected by subsequent fracturing operation.

Figure 4:
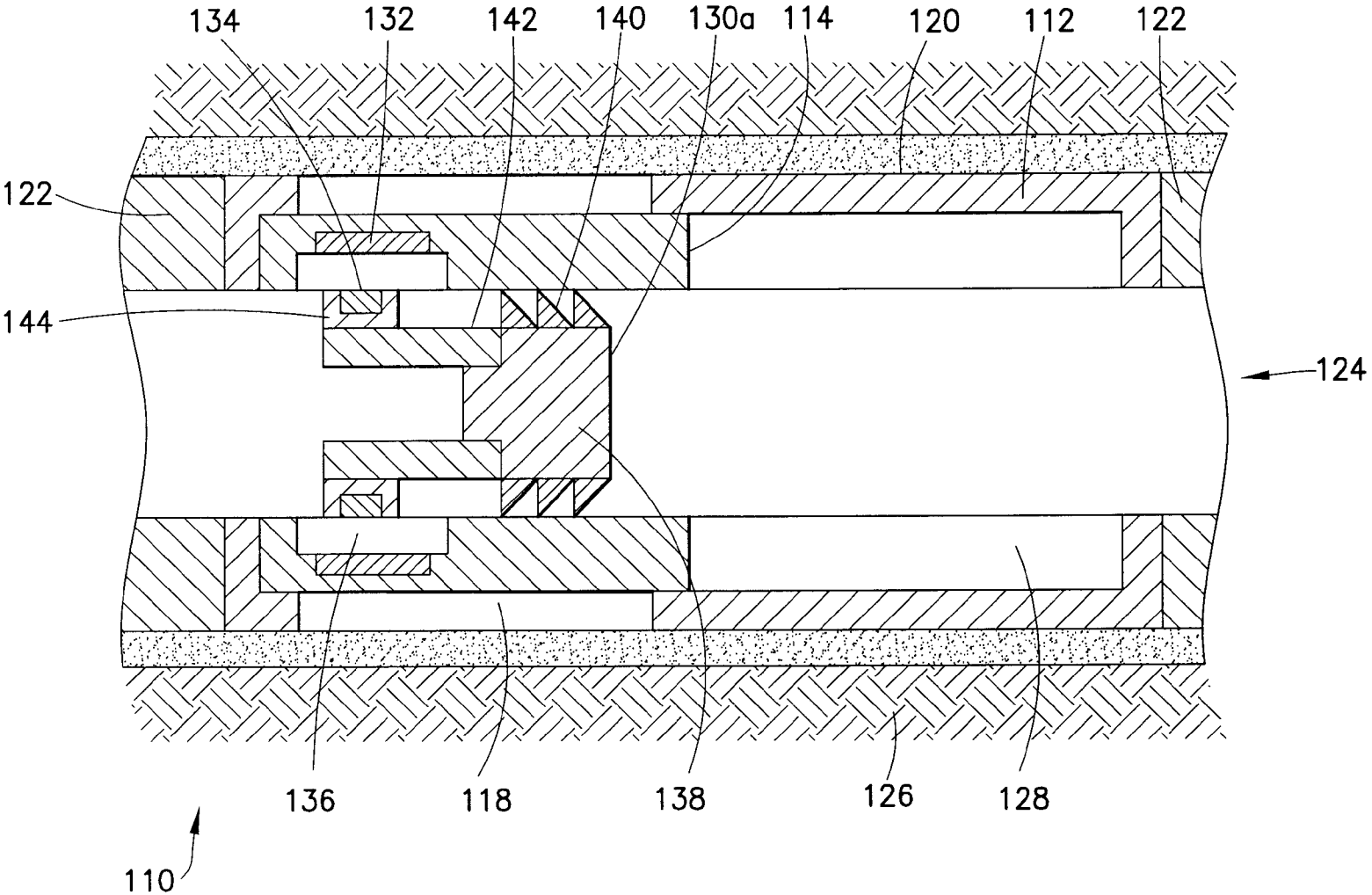
FIG. 4 is a cross-sectional view of a valve in a layout in accordance with the subject technology, wherein a different activation dart has reached a non-matching valve.

Referring now to FIG. 4, a cross-sectional view of a valve 112 in a layout 110 in accordance with the subject technology is shown, wherein a different activation dart 130 has reached a non-matching valve 112. In this version, the dart 130 is designed so that the mismatched magnets 132, 134 just will not attract without creating a repulsive force. Similar to the version of FIG. 3, in this case, the dart 130 will simply pass by the recess 136 without engaging the sliding sleeve 114 to open the valve 112. It is envisioned that a combination of mismatched pairs that both create and do not create repulsive force may be utilized depending upon the number of zones desired.

Figure 5:
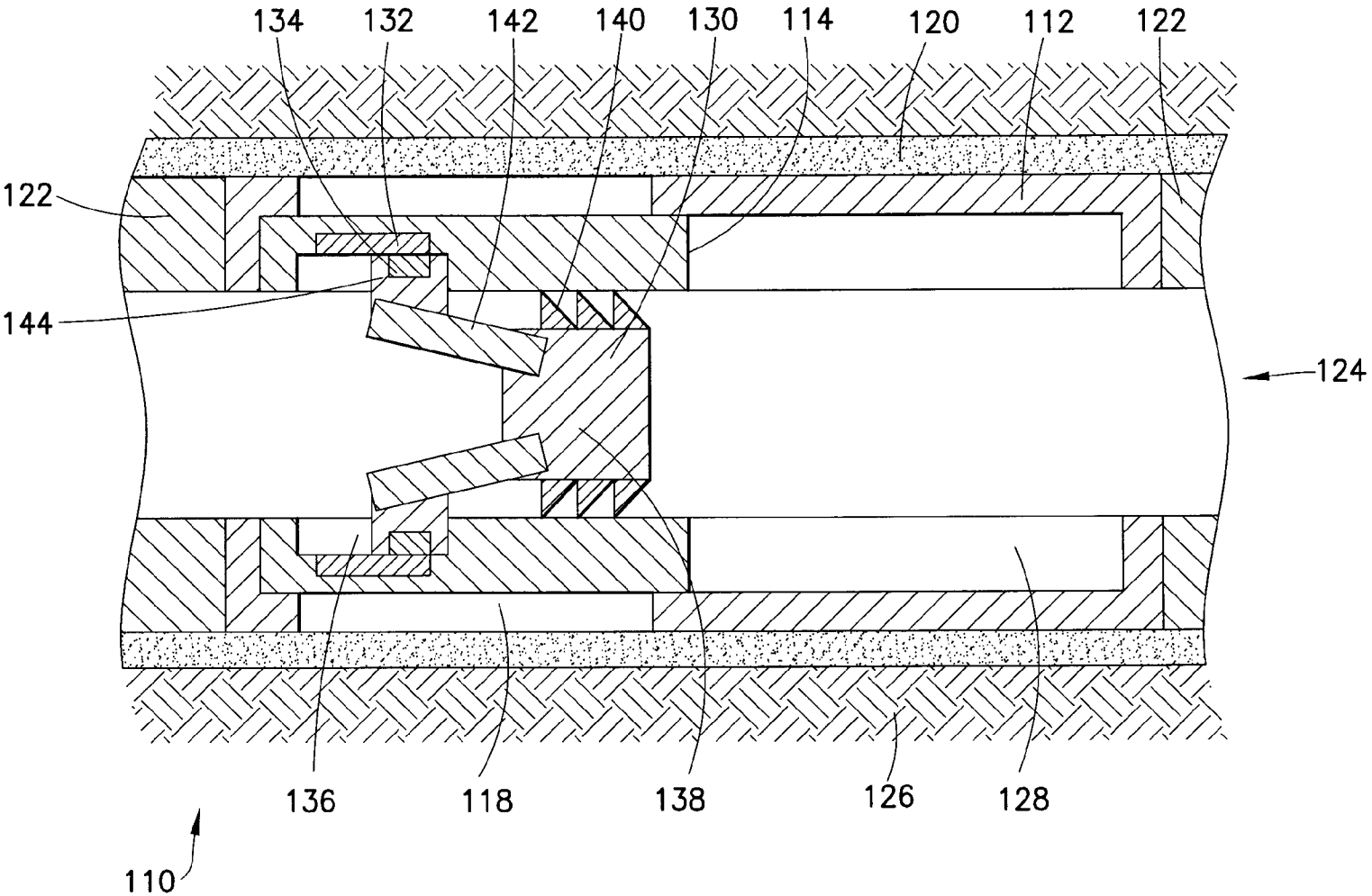
FIG. 5 is a cross-sectional view of a valve in a layout in accordance with the subject technology, wherein the activation dart has engaged the sliding sleeve of the valve but the valve is still closed.

Referring now to FIG. 5, a cross-sectional view of a valve 112 is shown, wherein the activation dart 130 has engaged the sliding sleeve 114 to begin opening the valve 112. When the dart 130 is passing through the valve 112 having the match pair of magnets 132, 134, activation or opening of the valve 112 occurs. As the dart magnets 134 align with the recess 136 in the sliding sleeve 114, if the sleeve magnets 132 and the dart magnets 134 are attracted to each other, the attractive force between the magnets 132, 134 pull the arms 142 radially outward into the recess 136. The tips 144 of the arms 142 engage or anchor within the recess 136 so that the dart 130 is stopped by and/or begins moving with the sliding sleeve 114.

Figure 6:
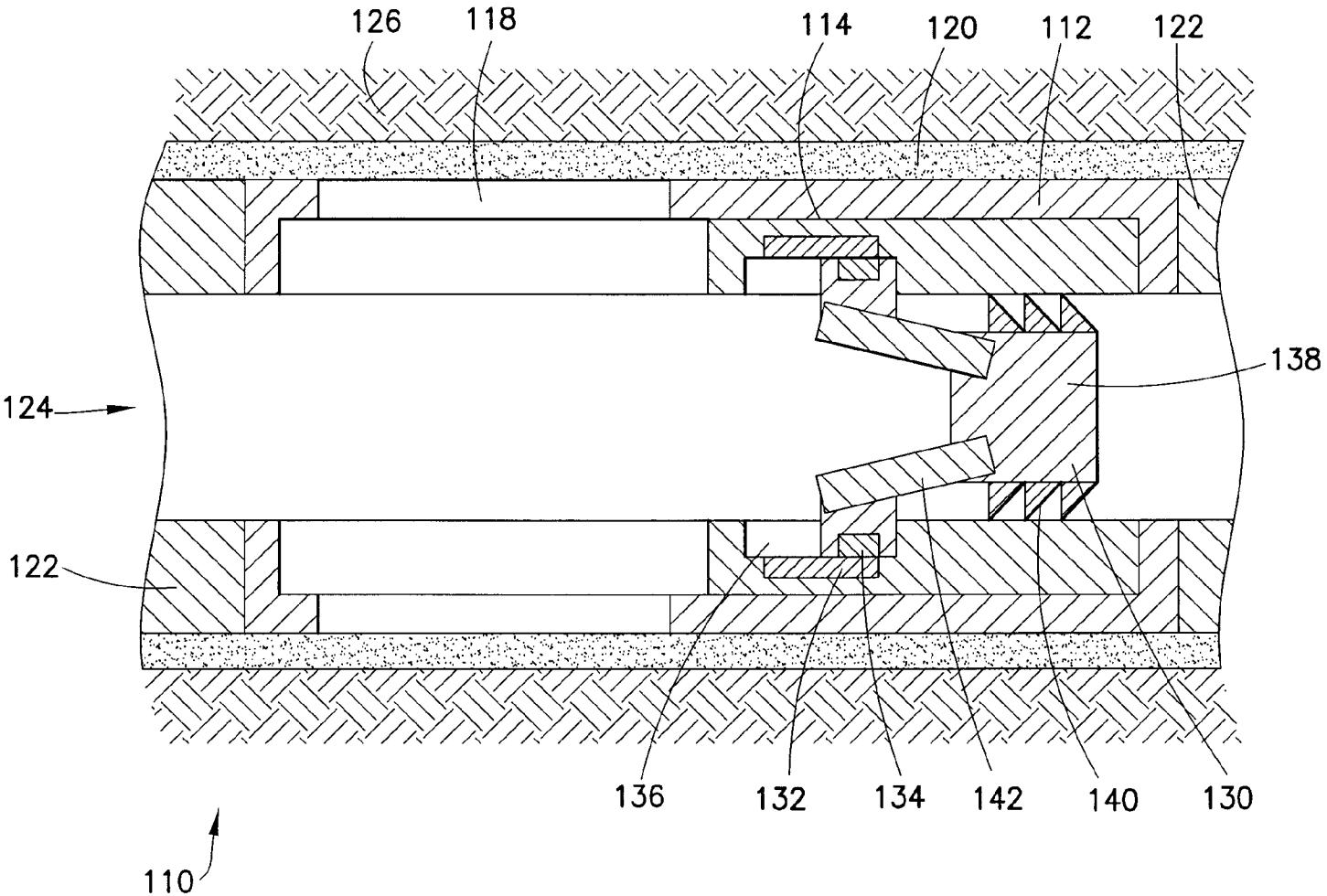
FIG. 6 is a cross-sectional view of a valve in a layout in accordance with the subject technology, wherein the activation dart has opened the valve.

As the pumping continues, the hydraulic forces exerted on the dart 130 push the sliding sleeve 114 to the "open" position as shown in FIG. 6. As a result, the pathway 118 is open, and the valve 112 is ready for fracturing operation. It is noted that full-bore access is achieved because of a recess 136 in the sliding sleeve 114 is used for activation instead of a restriction or protrusion.

As can be seen, the embodiment above uses a triggering mechanism of two sets of coded magnets 132, 134. Each zone that is intended for production would have a valve 112 with a matching dart 130 and sliding sleeve 114, i.e., the magnets 132, 134 are a matched pair of correlated magnets. In other words, a particular magnetic set 132 in the recess 136 can only be triggered by a reciprocal attractively coded dart magnets 134 that will be on a unique dart 130. Thus, each zone can only be opened by the unique matched activation dart 130. This yields the benefit that the subject technology is no longer restricted to opening zones in a specific sequence, but any of the zones can now be opened. Further, as shown below, with retreivability, the ability to shut off valves 112 allows optimization of the production profile of the well. Alternatively, the dart 130 may simply be made of dissolvable material or drilled out for removal.

A Second Embodiment

Figure 7:
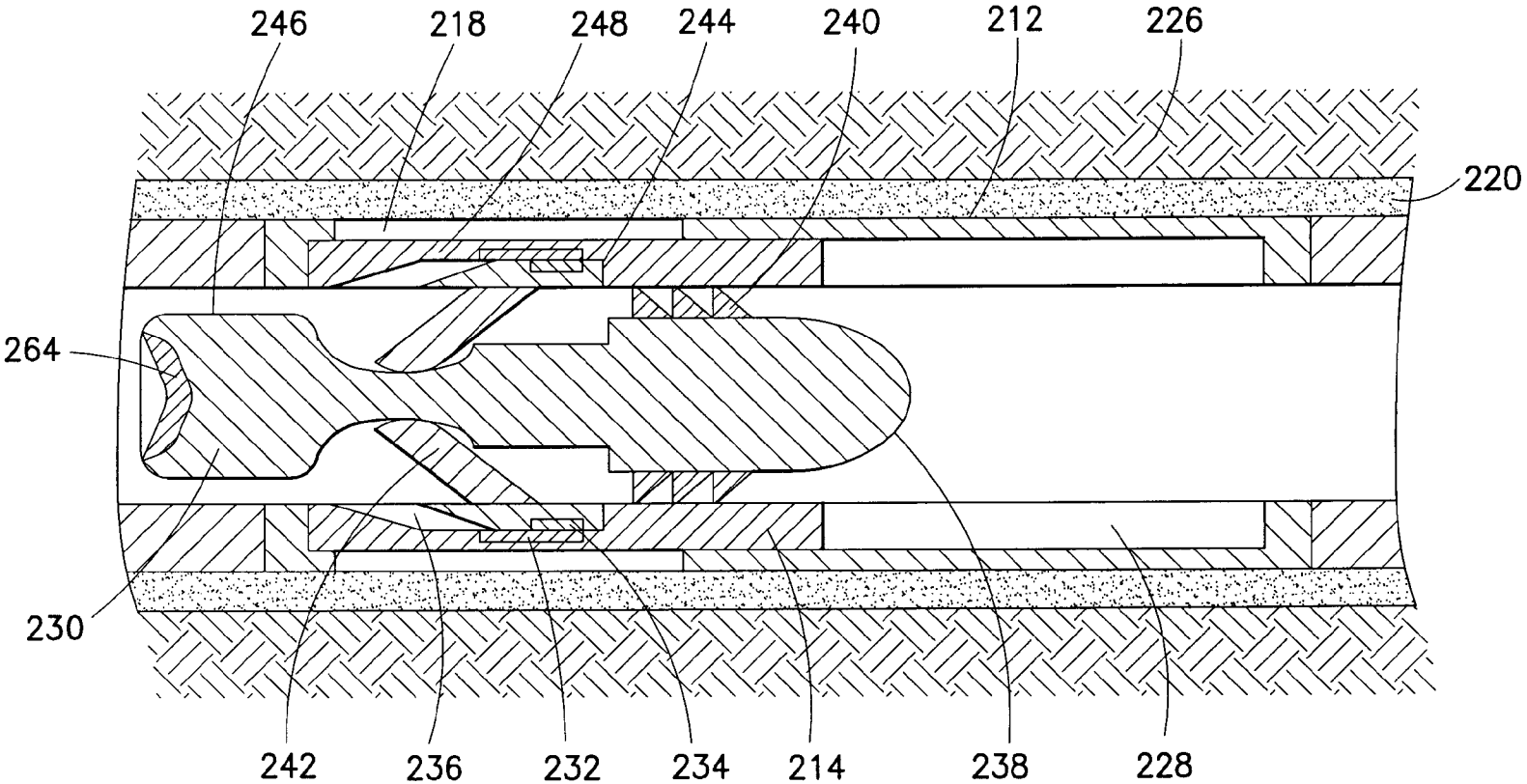
FIG. 7 is a cross-sectional view of another valve in accordance with the subject technology, wherein another activation dart has engaged the sliding sleeve of the valve but the valve is still closed.
Figure 8:
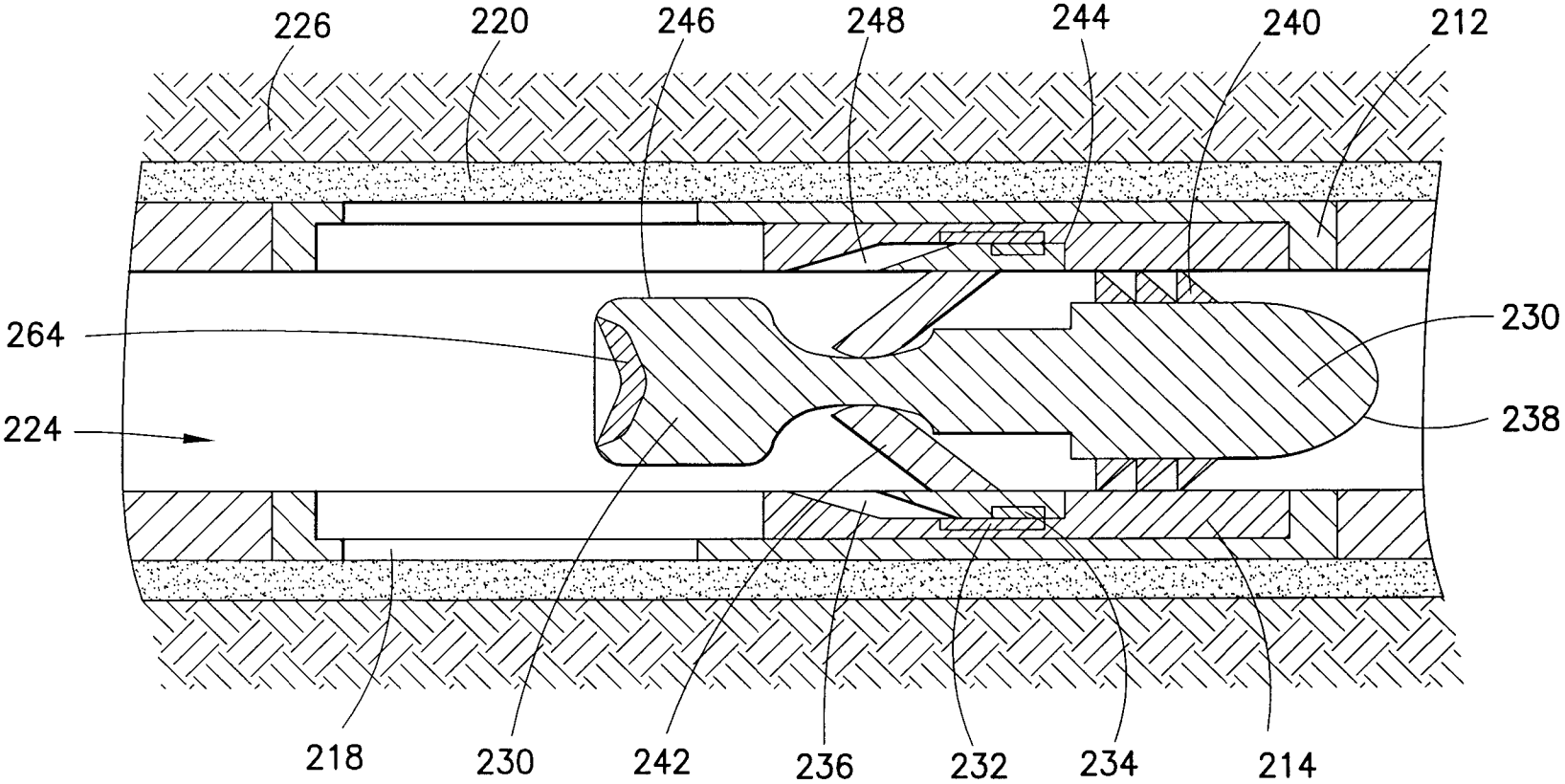
FIG. 8 is a cross-sectional view of the dart and valve of FIG. 7, wherein the activation dart has opened the valve.

Turning to FIGS. 7 and 8, another embodiment of a valve 212 and dart 230 in accordance with the subject technology are shown. The valve 212 and dart 230 are similar to the valve 112 and dart 130 described above, and therefore like reference numerals preceded by the numeral "2" instead of the numeral "1" are used to indicate like elements. A primary difference of the dart 230 in comparison to the dart 130 is that the dart 230 includes a tail block 246 and modified mounting of the arms 242 to facilitate retrieval of the dart 230.

FIG. 7 shows the dart 230 engaged with the sliding sleeve 214 in the closed position. FIG. 8 shows the dart 230 still engaged with the sleeve 214 but with the sliding sleeve 214 in the open position after the dart 230 is pushed down by fluid pressure. The engagement by mutual attraction of matched magnets 232, 234 on the sleeve 214 and arm tips 244, respectively, is again utilized. However, the arms 242 are mounted to the body 238 such that the radially movement outward is counterclockwise as shown (with left to right being a downward motion in the hole).

There are cases where one wishes to retrieve the dart 230 so that a lower zone can be restimulated. It may be desirable to leave the valve 212 open or close the valve 212 after retrieval of the dart 230. To accomplish retrieval, the tips 244 are trapezoidal in shape or chamfered to match a chamfer 248 in the recess 236. Therefore, during retrieval of the dart 230, the tips 244 and recess chamfer 248 will interact to create a radially inward closing force on the arms 242. Depending upon the balance of resistance to moving the sliding sleeve 214 to the closed position and the resistance to retract the arms 242 radially inward, the design can be modified to close the valve 212 or have the valve 212 remain in the open position. Hence, the valve 212 can be selectively opened and closed during retrieval of the dart 230.

In order to couple to a retriever (not shown), the dart tail block 246 includes magnets 264. Thus, a simple device may be lowered or pumped down to the dart 230 and magnetically coupled to the tail block magnets 264. As the retrieval device is pulled upward, the radially inward force created between the chamfer 248 and tips 244 effectively retracts or moves the arms 242 radially inward to allow decoupling from the recess 236. The magnets 264 may also be half of a matching set so that only a retrieval tool with the corresponding matched set can be used for retrieval.

A Retrieval Tool

Figure 9:
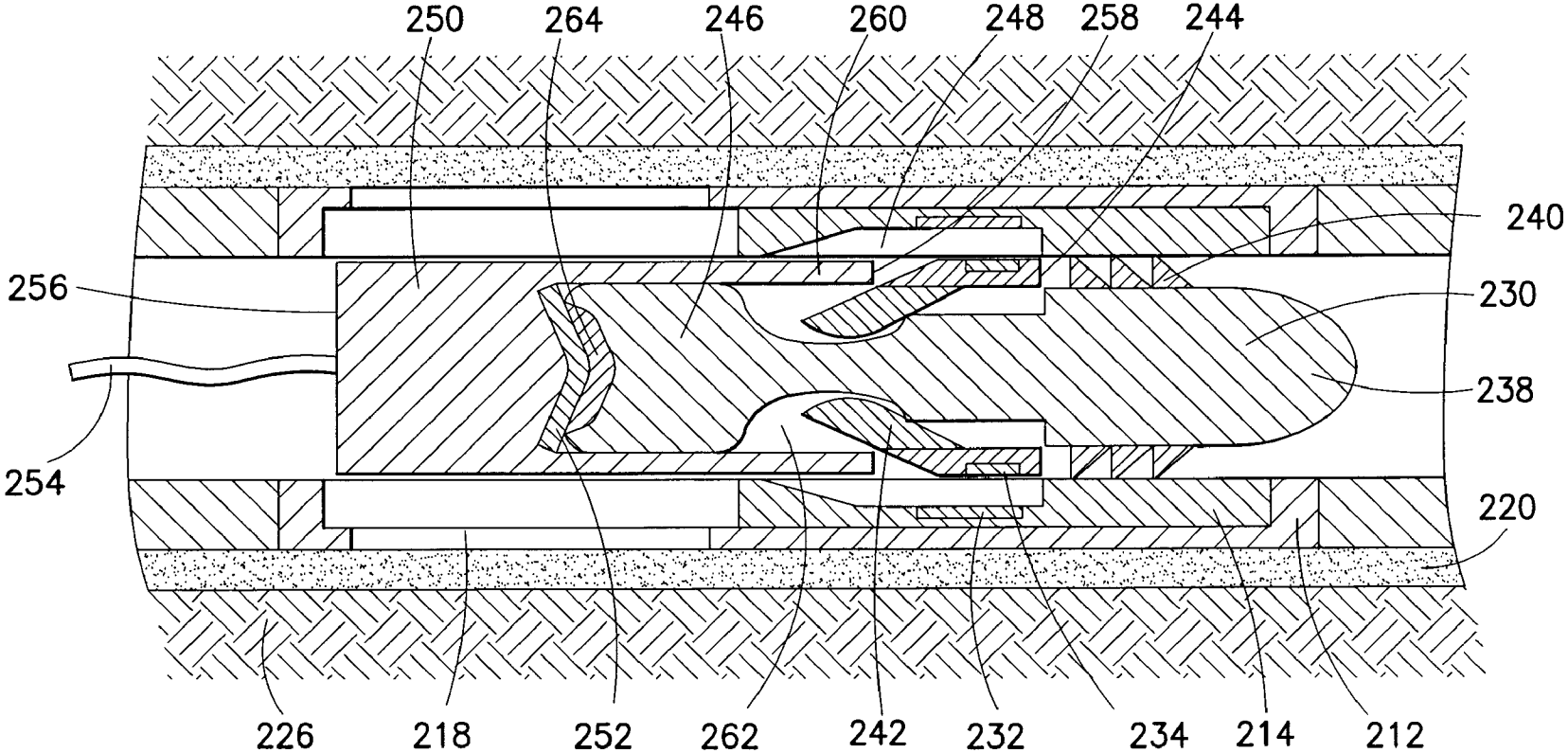
FIG. 9 is a cross-sectional view of the dart of FIGS. 7 and 8 being retrieved by a dart retriever.

Referring now to FIG. 9, a cross-sectional view of the dart of FIGS. 7 and 8 being retrieved by a dart retriever 250 is shown. The dart retriever 250 is particularly suited to decoupling the dart 230 from the recess 236 while leaving the valve 212 open. The dart retriever 250 is generally tubular with a tether 254 attached to a proximal end 256 so the retriever 250 may be pumped down and pulled back up by the tether 254. A distal end 258 includes a skirt 260 defining a bore 262. Magnets 252 are mounted within the bore 262.

During retrieval, the retriever 250 is lowered or pumped in hole to the dart 230. The retriever 250 is sized and shaped to orient the bore 262 so that the dart tail block 246 is received therein. As the dart tail block 246 enters the bore 262, magnetic attraction between the retrieval tool magnets 252 and dart tail block magnets 264 acts to pull the dart tail block 246 to the bottom of the bore 262 as shown. Consequently, the skirt 260 engages an outer surface of arms 242 to close the arms 242 radially inward. Thus, as the retriever 250 couples to the dart tail block 246, the magnetic attraction decouples the arms 242 from the recess 236. With the retriever-tail block attraction force strong enough to disengage the arms 242 from the sliding sleeve 214 without moving the sliding sleeve 214, upwards pulling on the tether 254 will bring back the retriever 250 and dart 230 therewith. It is also envisioned that the mechanical forces created by the chamfer 248 and skirt 260 can cooperate to effectively close the arm 242 of the dart 230 for retrieval. As can be seen, the darts 230 can be configured wherein one dart 230 is utilized to open the valve 212 and another dart 230 is used to close the valve 212.

A Third Embodiment

Figure 10:
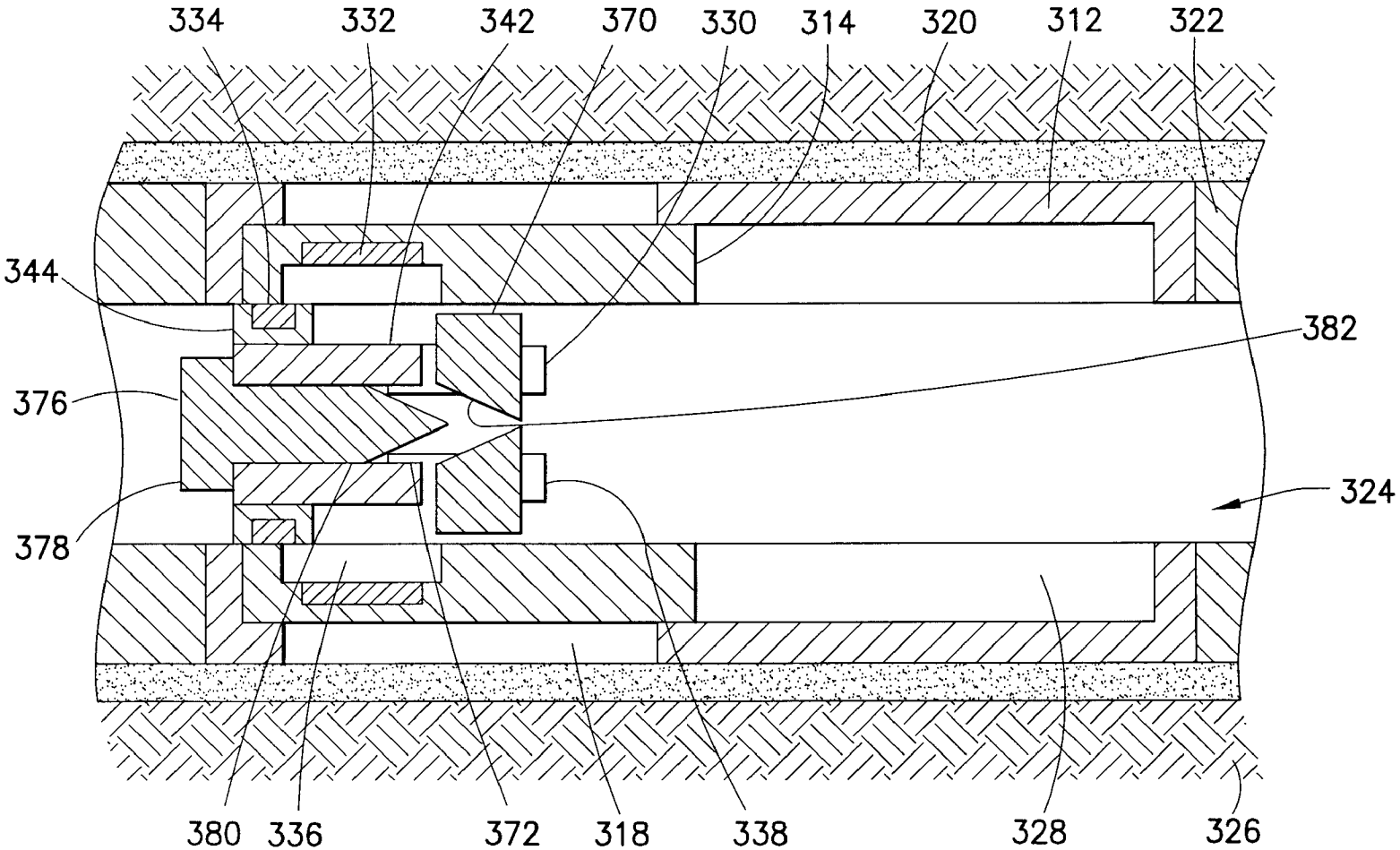
FIG. 10 is a cross-sectional view of another dart in accordance with the subject technology, wherein the activation dart has secondary action but shown as not yet deployed.
Figure 11:
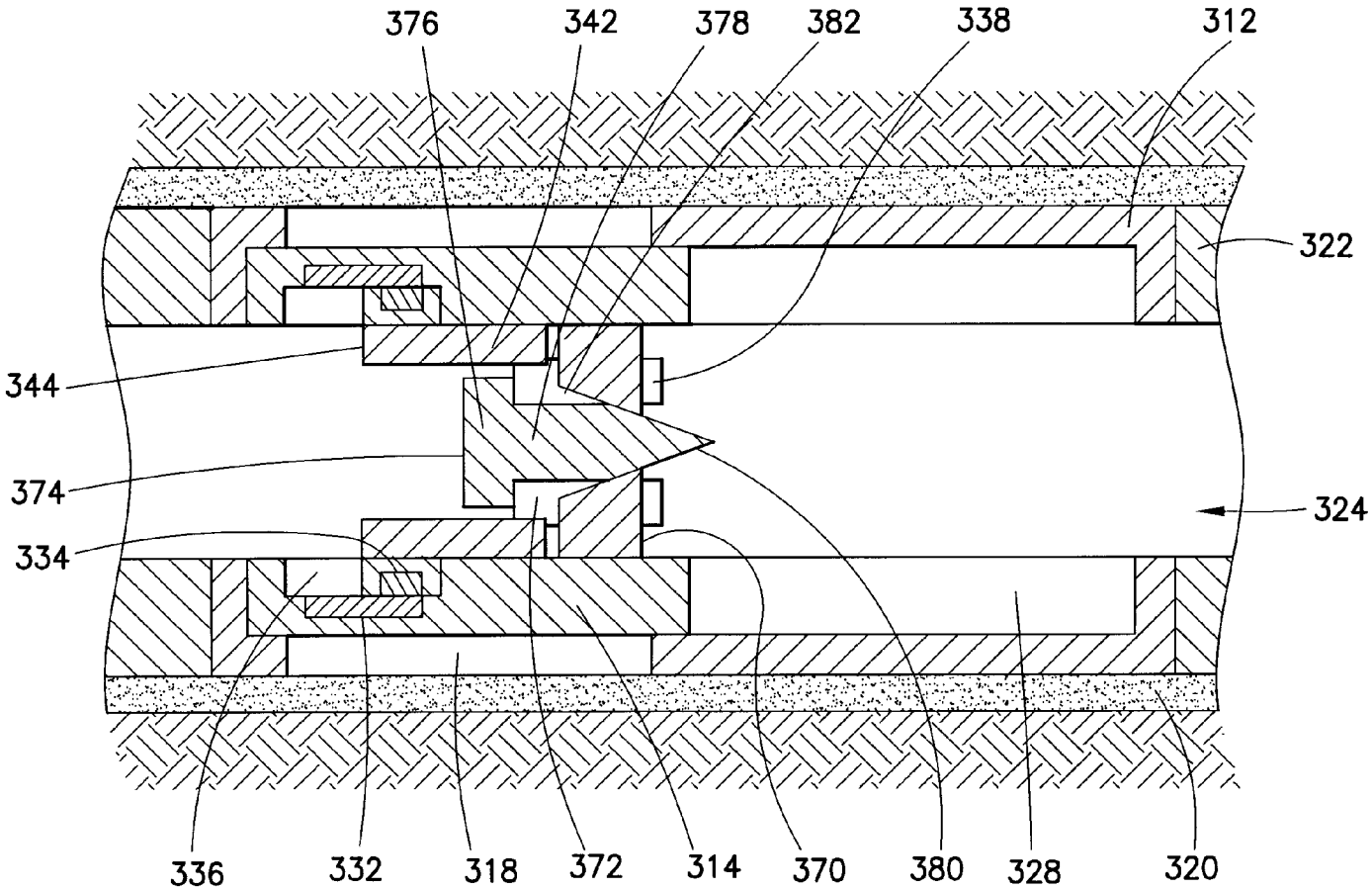
FIG. 11 is a cross-sectional view of the dart of FIG. 10, wherein the secondary action of the dart has been deployed.

Turning to FIGS. 10 and 11, another embodiment of a dart 330 in accordance with the subject technology is shown being deployed in a valve. The dart 330 is similar to the darts 130, 230 described above, and therefore like reference numerals preceded by the numeral "3" instead of the numerals "1" or "2" are used to indicate like elements. A primary difference of the dart 330 in comparison to the darts 130, 230 is that the dart 330 includes a secondary latching action to activate movement of components such as seals 370 that engage the valve 312.

Similar to above, correlated magnets 332, 334 on the sleeve 314 and arms 342, respectively, are used to initiate the secondary latching on the valve 312. The body 338 of the dart 330 forms a piloting mandrel or guide 372 to which the arms 342 pivotally mount. The arms 342 retain a plunger 374 when in the neutral position. The plunger 374 has a proximal head 376 with an opposing stem 378 extending therefrom such that a collar is formed that rests upon the proximal end or tip 344 of the arms 342. The stem 378 is elongated and extends to a distal pointed tip 380 that does not reach the piloting mandrel 372 when the arms are in the neutral position shown in FIG. 10. The body 338 also carries seals 370, which are mounted for axial movement between the disengaged position shown in FIG. 10 and the engaged position shown in FIG. 11.

Referring particularly to FIG. 11, when the dart 330 reaches the sliding sleeve 314 so that the arms 342 rotate outwardly from the attractive force of the magnets 332, 334, the plunger head 376 passes between the arms 342 into the piloting mandrel 372. Pressure drives the plunger 374 through the mandrel 372 so that the distal tip 380 engages a camming surface 382 of the seals 380. As a result, the seals 380 are driven axially outward to engage the sliding sleeve 314 of the valve 312. Upon such deployment, the dart 330 has increased pressure build up to accomplish movement of the sliding sleeve 314 from the closed position to the open position.

Figure 12:
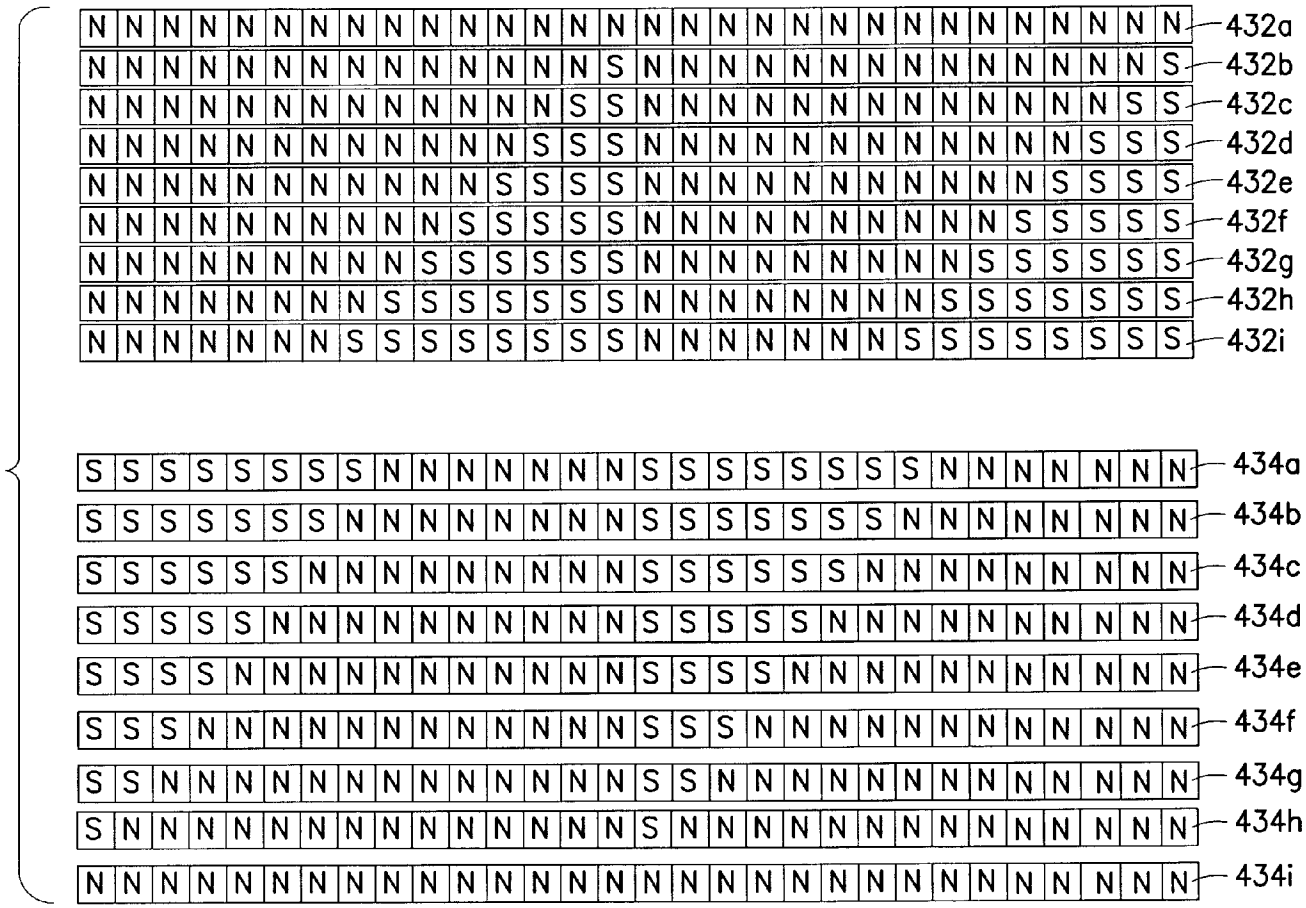
FIG. 12 is a somewhat schematic illustration of nine combinations of matched pairs of magnets for use with darts and sliding sleeves in accordance with the subject technology, wherein unmatched pairs generally generate a repulsive force.

Referring now to FIG. 12, a somewhat schematic illustration of nine combinations of matched pairs of magnets 432*a-i*, 434*a-i* for use with darts and sliding sleeves are shown. These matched pair magnets 432*a-i*, 434*a-i* are fabricated so that unmatched pairs generally generate a repulsive force. For example, magnet 432*a* and magnet 434*a* are matched in that when aligned each sub-portion corresponds to the opposite pole to create an attractive force. In contrast, magnet 432*a* and magnet 434*b* would align so that sixteen sub-portions would have the same pole to create repulsive forces and fourteen sub-portions would have opposite poles to create attractive forces. However, the net force would be generally repulsive because of the larger number of sub-portions creating repulsive force. And so it is for the remaining combinations as well in that only the matched pairs attract.

It is envisioned that the magnets 432, 434 would be arranged in a circular, annular or arcuate array on the respective dart and sliding sleeve but other configurations are possible. In this configuration, magnets 432*i*, 434*i* would be the bottom pair, i.e., set in the bottom sleeve and first dart dropped in hole. Each set of magnets would then correspond to the next zone up until magnets 432*a*, 434*a* were utilized for the top zone and the darts would be dropped in a bottom up sequence.

Figure 13:
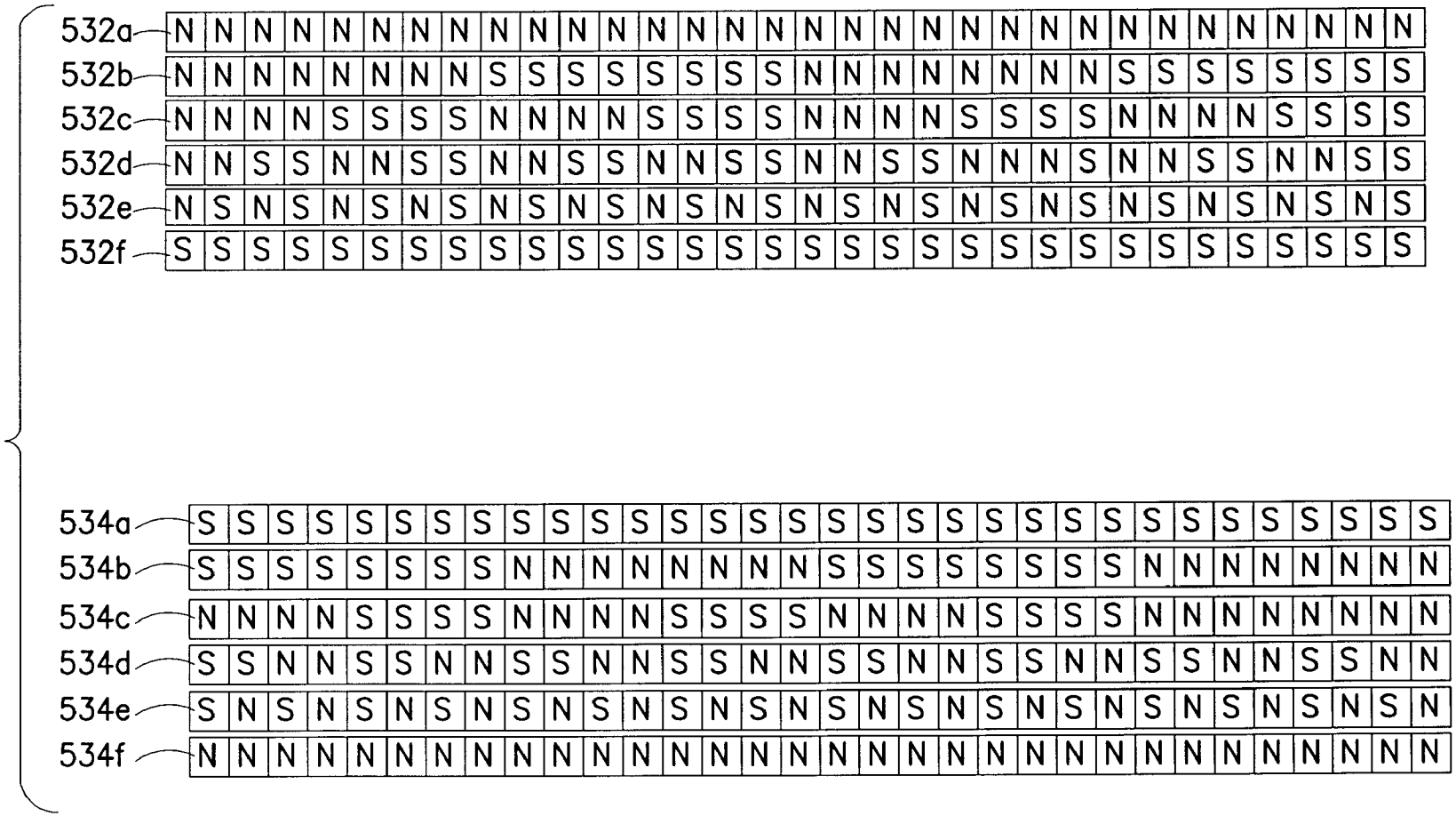
FIG. 13 is a somewhat schematic illustration of five combinations of matched pairs of magnets for use with darts and sliding sleeves in accordance with the subject technology, wherein unmatched pairs generally generate no attractive or repulsive force.

Referring now to FIG. 13, a somewhat schematic illustration of another five combinations of matched pairs of magnets 532*a-f*, 534*a-f* for use with darts and sliding is shown. These magnets 532*a-f*, 534*a-f* differ from those of FIG. 12 in that unmatched pairs generally generate no attractive or repulsive force, yet matched pairs generate a strong attractive force. Thus, no sequential order of arranging and dropping the darts in hole is required.

In view of the above, it is also envisioned that the correlated magnets may create rotational and/or snap forces on the components such as the sliding sleeves, dart and dart retrieval to accomplish the desired performance. In another embodiment, the dart arms retain a loaded spring such that upon movement of the dart arms radially outward, the spring unloads to create the secondary movement or latching. The components that are moved by the secondary action may be seals, keys or the like which get forced towards the valve forming other contact points between the dart and the valve. The keys may also have a matching profile with the surfaces in the valve to promote more effective engagement.

In still another embodiment, the dart may be provided with a motor that receives an electrical signal to rotate the dart arms so that the arms can or disengage the valve with or without the usage of correlated magnets. A further embodiment may utilize RFID technology with a power source in the dart and/or sliding sleeve or valve to accomplish the interaction between the dart and sliding sleeve. Such action may even be programmed to release after a set duration to allow simply pumping the dart to the bottom of the hole.

As would be appreciated by those of ordinary skill in the pertinent art, the subject technology is applicable to use as an actuation mechanism with significant advantages for activating and deactivating in hole zones repeatedly as well as other devices such as packers. The functions of several elements may, in alternative embodiments, be carried out by fewer elements, or a single element. Similarly, in some embodiments, any functional element may perform fewer, or different, operations than those described with respect to the illustrated embodiment. Also, functional elements shown as distinct for purposes of illustration may be incorporated within other functional elements, separated in different hardware or distributed in various ways in a particular implementation. Further, relative size and location are merely somewhat schematic and it is understood that not only the same but many other embodiments could have varying depictions.

INCORPORATION BY REFERENCE

All patents, published patent applications and other references disclosed herein are hereby expressly incorporated in their entireties by reference.

While the invention has been described with respect to preferred embodiments, those skilled in the art will readily appreciate that various changes and/or modifications can be made to the invention without departing from the spirit or scope of the invention as defined by the appended claims. For example, each claim may depend from any or all claims in a multiple dependent manner even though such has not been originally claimed.

What is claimed is:

1. A mechanism for selectively activating a plurality of downhole pathways comprising:

a) a valve including: i) a sleeve coupled for movement between an open and normally closed position; and ii) a valve magnet set mounted to the sleeve; and b) a dart for pumping in hole including a dart magnet set matched to the valve magnet set such that the dart couples to the valve when in close proximity and, in turn, the sleeve moves from the closed position to the open position.

2. A mechanism as recited in claim 1, wherein the sleeve defines a recess in which the valve magnet set is mounted and the dart includes arms moveably mounted, the dart magnet set being mounted on the arms such that upon magnetic coupling, the arms move into the recess and anchor the dart to the sleeve.

3. A mechanism as recited in claim 2, wherein the recess has a chamfer and the arms form an anchor portion that engages the recess and has a complimentary chamferred portion that engages the chamfer during retrieval of the dart.

4. A mechanism as recited in claim 2, wherein the arms move radially outward in a rotational direction against that of fluid flow being pumped into the downhole.

5. A mechanism as recited in claim 2, further comprising a second valve including: i) a sleeve coupled for movement between an open and normally closed position; and ii) a second valve magnet set mounted to the sleeve such that the second valve magnet set and the dart magnet set create a repulsive force to move the arms radially inward when in close proximity.

6. A mechanism as recited in claim 2, further comprising springs coupled to the arms to set a normal position thereof.

7. A mechanism as recited in claim 6, wherein a coupling means is a tail magnet set.

8. A mechanism as recited in claim 2, further comprising a retrieval tool including a tool magnet set coded for coupling to the tail magnet set.

9. A mechanism as recited in claim 8, wherein the retrieval tool includes a skirt portion for creating a closing force of the arms during coupling of the tail and tool magnet sets.

10. A mechanism as recited in claim 8, further comprising a tether attached to the retrieval tool.

11. A mechanism as recited in claim 2, wherein the dart further includes a plunger selectively coupled to the arms, a guide portion and seals moveably mounted to the dart such that upon the arms engaging the sleeve, the plunger is released to pass through the guide and, in turn, move the seals to engage the sleeve.

12. A mechanism as recited in claim 1, further comprising seals mounted on the dart.

13. A mechanism as recited in claim 1, wherein the dart includes a tail block having coupling means mounted thereto.

14. A mechanism for selectively activating a plurality of downhole devices comprising:

first means for triggering a device by moving from an off position to an on position; and second means for moving the first means from the off position to the on position wherein the device is a valve, the first means is a sliding valve sleeve having a coded valve magnet set, and the second means is a dart having a coded dart magnet set such that the coded valve and dart magnet sets are uniquely matched to create an attractive force when in close proximity.

15. A method for selectively activating a triggering mechanism on a plurality of downhole valves comprising the steps of:

pre-determining combinations of coded magnets such that each valve sleeve of the downhole valve includes a valve magnet set that is only attracted to unique dart magnet set mounted on an activation dart; and opening the downhole valves in a sequence by selecting a sequence of unique darts to be pumped in hole.

16. A method as recited in claim 15, further comprising the step of having mismatched magnet sets create a repulsive force when in close proximity.

17. A method as recited in claim 15, further comprising the step of dissolving the unique darts.

18. A method as recited in claim 15, further comprising the step of retrieving the unique darts while leaving at least one respective valve open.

19. A method as recited in claim 15, further comprising the step of retrieving the unique darts while closing at least one respective valve.

20. A method as recited in claim 15, further comprising the steps of closing a previously opened valve; and reopening the previously opened and closed valve.

* * * * *